United States Patent [19]

Toro Sósa et al.

[11] 4,190,379

[45] Feb. 26, 1980

[54] DEVICE FOR RESERVING INDIVIDUAL PARKING AREAS

[76] Inventors: German Toro Sósa, Apolonia Morales, 21-90; José L. Sever Ezcurra, Apolonio Morales, 21-80, both of Madrid, Spain

[21] Appl. No.: 912,988

[22] Filed: Jun. 6, 1978

[30] Foreign Application Priority Data

Nov. 16, 1977 [ES] Spain ..... 232.091[U]
Mar. 28, 1978 [ES] Spain ..... 234.966[U]

[51] Int. Cl.[2] ..... E01F 13/00
[52] U.S. Cl. ..... 404/6; 49/35
[58] Field of Search ..... 404/6, 11; 292/205, 292/213, 218; 49/131, 35, 132, 133, 134, 394

[56] References Cited

U.S. PATENT DOCUMENTS

| | | | |
|---|---|---|---|
| 510,181 | 12/1893 | Mallory | 292/218 |
| 777,135 | 12/1904 | Parsons | 292/205 X |
| 798,583 | 8/1905 | Harris | 292/205 X |
| 1,736,326 | 11/1929 | Purcell | 404/11 |
| 2,074,759 | 3/1937 | Richards | 292/213 X |
| 2,095,016 | 10/1937 | Waterbor | 404/11 |
| 3,042,435 | 7/1962 | Wieseler | 292/213 |
| 3,451,705 | 6/1969 | Turpen | 292/218 |
| 3,600,853 | 8/1971 | Goldberg | 49/35 |
| 3,750,331 | 8/1973 | Renaux | 49/35 |
| 3,888,527 | 6/1975 | Haisler | 292/213 |

*Primary Examiner*—Nile C. Byers, Jr.
*Attorney, Agent, or Firm*—Wenderoth, Lind & Ponack

[57] ABSTRACT

A device for reserving individual parking areas includes a U-shaped rigid element having parallel legs which are substantially shorter than the intermediate leg which is loosely inserted in at least two clamps which constitute 90° turning zones in a single direction for the U-shaped element. The clamps form an integral part of a platform or plate through which the assembly is mounted onto the floor at the entrance to an individual parking area. The plate has a perforated lug insertable in a groove existing in a bracket joined to the intermediate leg of the U-shaped element.

8 Claims, 16 Drawing Figures

DEVICE FOR RESERVING INDIVIDUAL PARKING AREAS

The present invention refers to a device for reserving individual parking areas.

Now that the automobile industry is developing and the cities are growing physically and demographically, there is a lack of space for the parking of vehicles, a shortage which has created a problem frequently originating abuses concerning the right of property, inasmuch as, in view of the existing need, drivers park their vehicles in places not corresponding to them which they normally do due to the lack of appropriate physical means to prevent this, prejudicing the right of the lawful owner to park his own vehicle within what is his property which has abusively and temporarily been used illegally by a third party. This leads to frustrations, unrests and, in some cases, physical violence to persons and property.

Various attempts have been made to overcome these drawbacks, namely:

(a) Indicating by posters that the sites have owners (sometimes with explicit threats) which is generally not respected because the unlawful user of a parking site knows what he is doing and a normal notification or a fine will not inhibit his action.

(b) Placing movable physical obstacles, such as barriers, fences, etc., which are somewhat more effective than posters. However, the moving of these obstacles becomes tiresome and inconvenient for the lawful owner.

(c) Placing at the entrance to the parking area chained and padlocked posts which prevent the passage to a parking area. This is a sufficiently effective method and perhaps the most divulged, but it has many inconveniences: when the chain is in a low position or loose it should be collected, which operation becomes inconvenient; it is not always possible to fix the posts to which the chain is fastened, which posts always interfere with the operation of entering into the parking areas; and the safety offered thereby is rather relative, since the chains can be broken or the posts can be moved by the vehicle itself.

(d) Individual vertical barriers are also normally placed at the entrance to the parking area, which can be movable but fixed with padlocks and locks. However, a space to store the barrier, or else a collapsible rod with a lock, is required. This method has various defects:

1. The rods can be pulled out inasmuch as they can be moved by the bumper of the vehicle.

2. Since they are placed in a series of parking areas, the potential unlawful user can park a vehicle in an intermediate position between two parking areas, taking advantage of the space between two protecting mechanisms. This could be prevented by placing two or more protecting mechanisms in each parking site. However, this would complicate the operation enormously for the own user.

(e) Placing strong movable grates. This method requires a greater space in width for each vehicle. Therefore, it is limited by the physical possibilities and the legal standards which permit the works to be undertaken.

(f) Placing collapsible fences at the entrance to the parking area, said fences having a closure mechanism. This system presents the problem that it should be folded inwards, which would prevent them from being closed when the vehicle is parked, or folded outwards of the parking area, whereby, when open, they would interfere with the passage of other vehicles. These fences can also be moved when pushed by the bumper of the vehicle.

In view of the described problems which are present in all the known systems, the device of the present invention has been designed as a solution to the protection of parking areas. Said device comprises a barrier which prevents vehicles from entering or leaving the parking area. It is basically a collapsible barrier fixed to the flooring of the parking area which has the following characteristics:

(a) When the barrier is lowered, since its width is of 70 cm. approximately, and its height is of 10 cm., the vehicle which uses the parking area can pass readily.

(b) When the barrier is raised, it has two vertical rods spaced from each other in 70 cm. which constitute an obstacle for the passage of the vehicle. Said vertical rods have an approximate height of 30 cm. so that they cannot be moved by the bumpers of the vehicles, but they are sufficiently high so as to prevent a vehicle from passing since the lower parts thereof (petrol tank, gearbox, etc.) will knock them, which parts will be damaged by the said two vertidcal rods.

Nevertheless, for those special cases in which it is desired to cancel the destructive action of the barrier, the vertical rods will be joined at their free ends by means of a piece of tube, the device not being altered in any way with respect to the protection of the parking area and the vehicle duly parked.

(c) The barrier, when raised to prevent vehicles from passing, can be fixed in this position by padlocks or locks.

(d) Since the barrier has a width of approximately 70 cm. and the parking areas normally have a width of 230 cm., if the parking protection device is placed in each one of a series of aligned areas, there would be a separation of 160 cm. between two devices, a separation which would be insufficient for the abusive introduction of an automobile which occupies a portion of two consecutive areas.

To complement the description which will now be made, given by way of example, and for a better understanding of the characteristics of the invention, a set of drawings is attached hereto, forming an integral part of this specification, wherein the following is represented:

FIGS. 1, 2 and 3 correspond, respectively, to a longitudinal elevation view, an upper plan view, and a side elevational view of the device of the present invention.

FIGS. 6 to 13, both inclusive, illustrate another embodiment of the device described, FIGS. 6, 7, 8 and 9 corresponding respectively to a longitudinal elevation view, an upper plan view, a side elevational view and a lower plan view.

Figure 1:
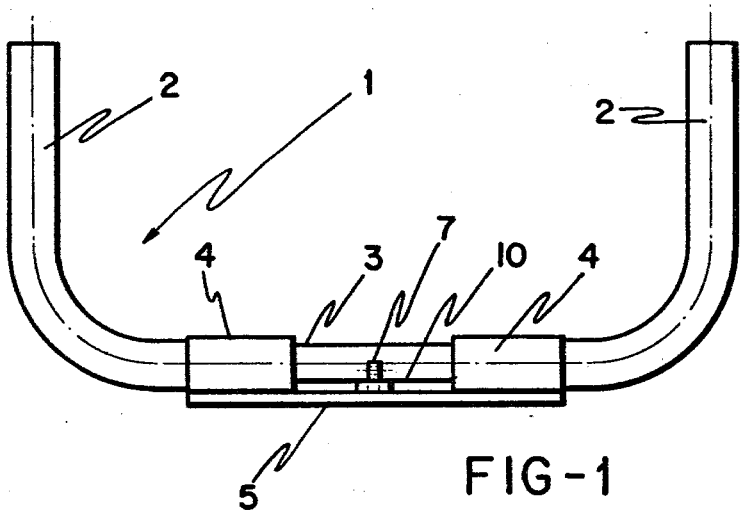
Figure 2:
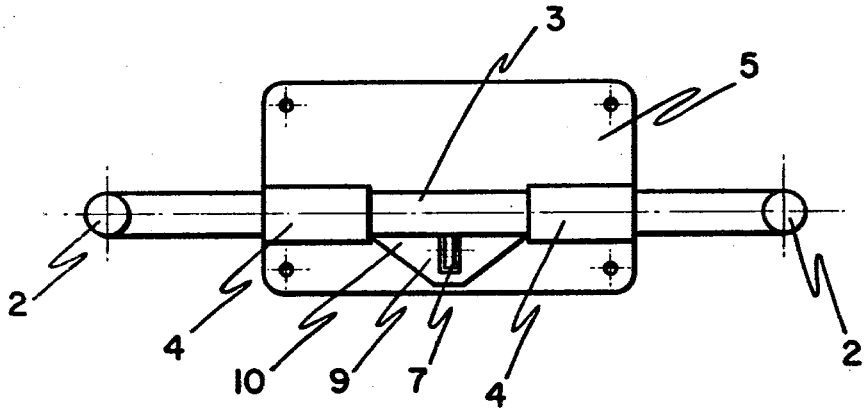
Figure 3:
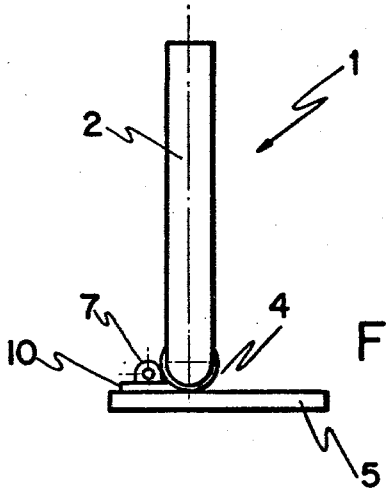
Figure 4:
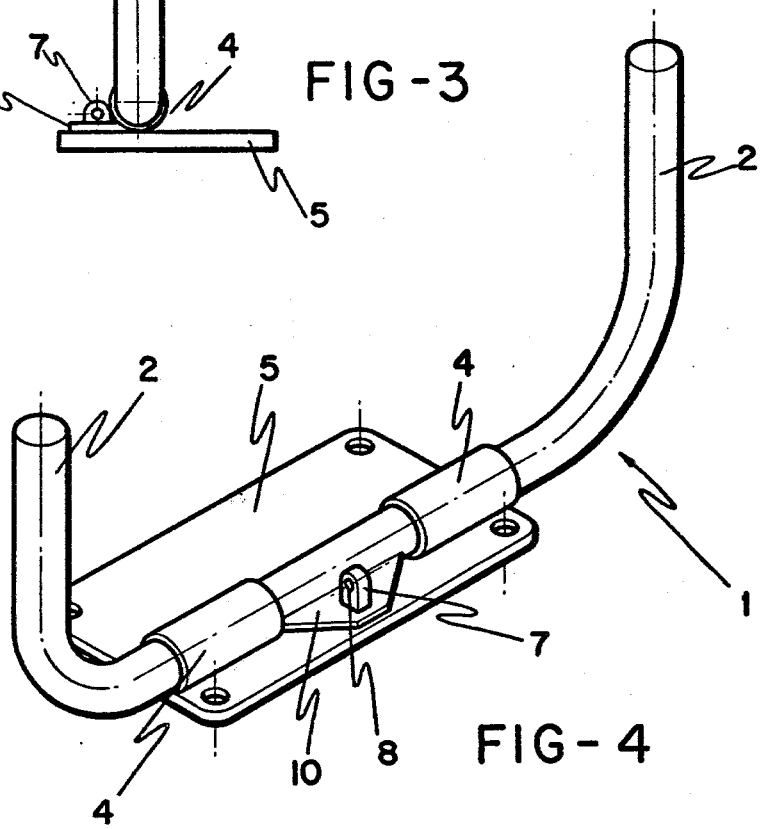
FIG. 4 represents a perspective view of the device in the operative position, that is to say, with the barrier raised to prevent vehicles from entering into the individual parking area, at the entrance of which the device is situated.
Figure 5:
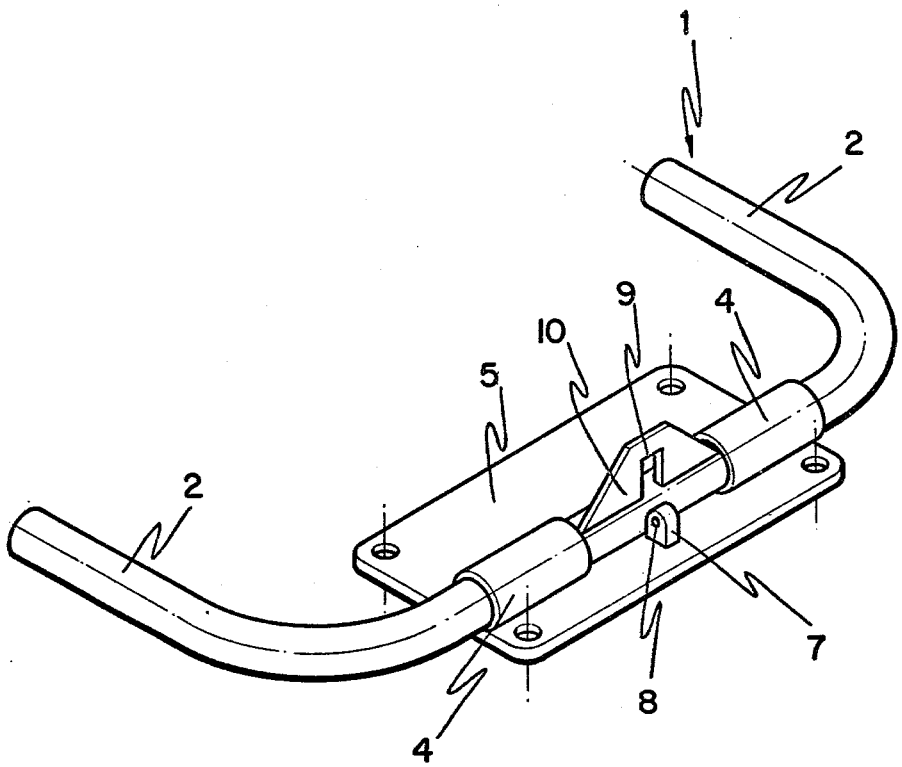
FIG. 5 illustrates a perspective view of the device in its folded or inoperative position, which permits the entrance and exit of the vehicles.
Figure 6:
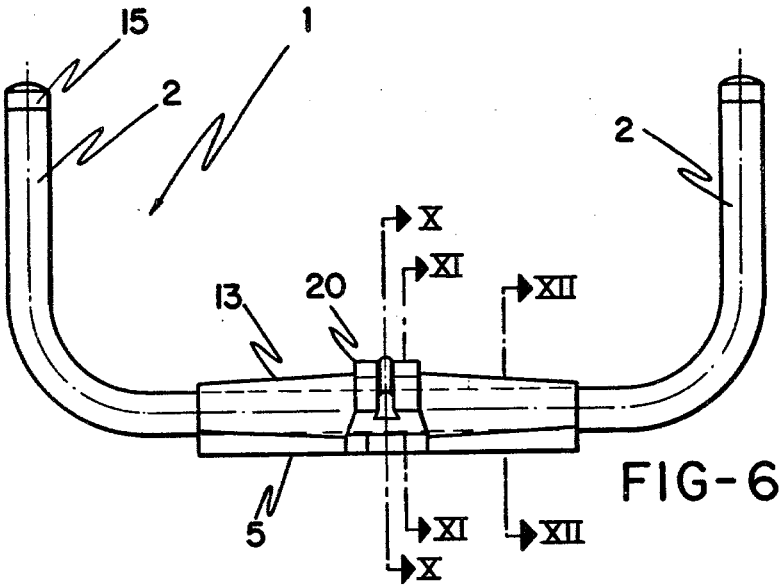
Figure 7:
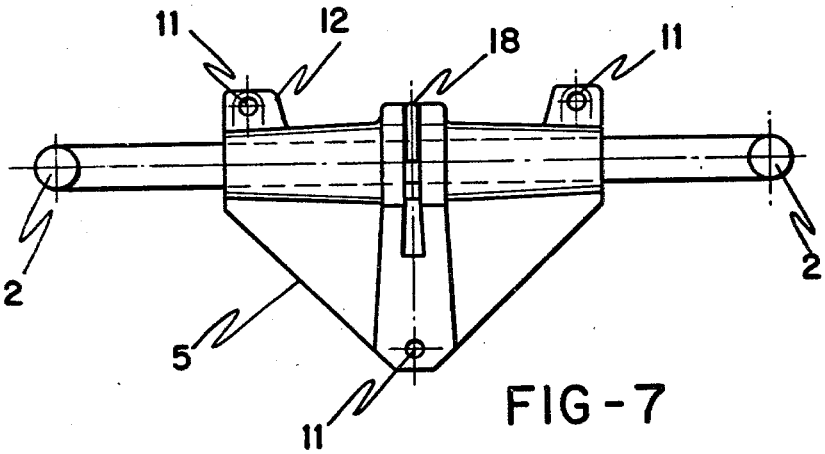
Figure 8:
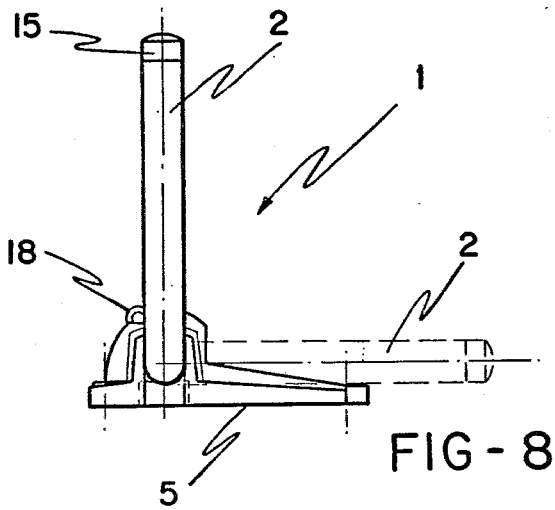
Figure 10:
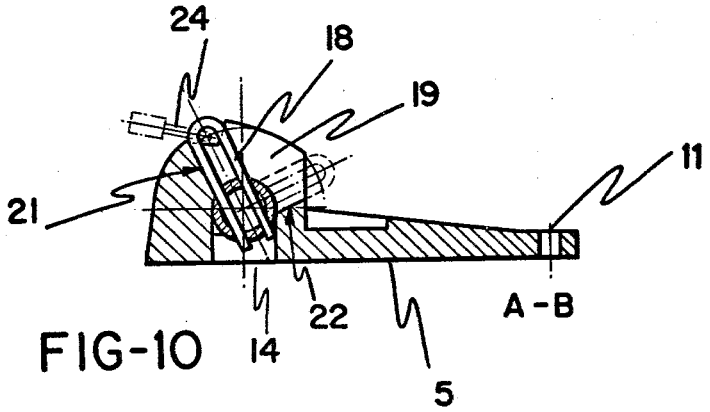
Figure 11:
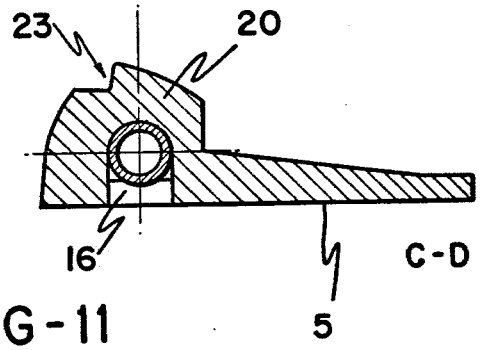
Figure 12:
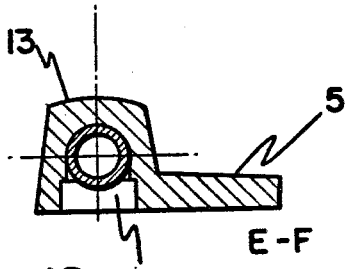

FIGS. 10, 11 and 12 represent side sections taken along lines A–B, C–D and E–F of FIG. 6.

Figure 13:
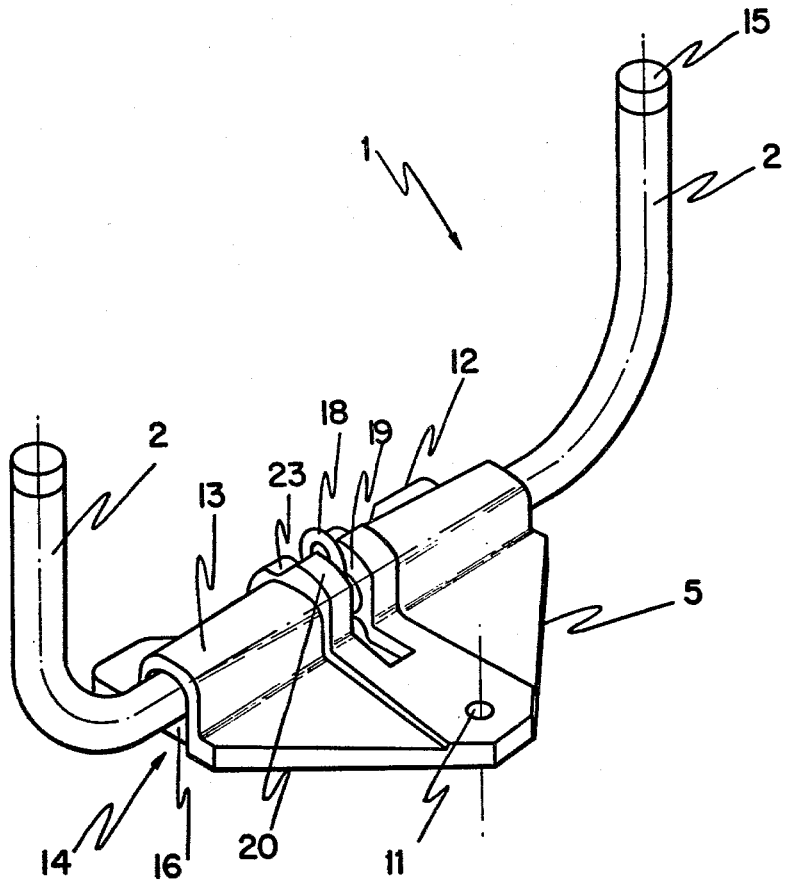

FIG. 13 illustrates a perspective view of the device made according to this embodiment.

Figure 14:
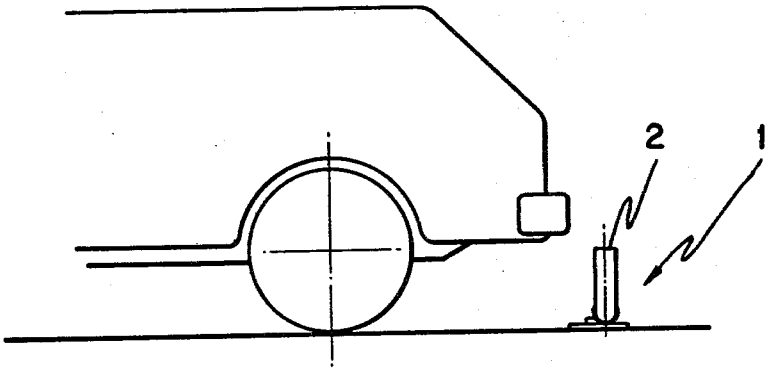

FIG. 14 illustrates, schematically, the posterior half of a parked automobile protected by the described device. It can be seen how said protection originates from the vertical elevation or arrangement of the barrier.

Figure 15:
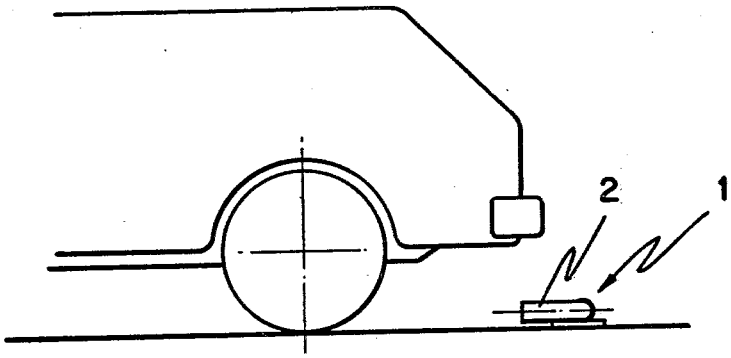

FIG. 15 is similar to the former with the only difference that the barrier is now folded to permit the free exit and entrance of the automobile.

Figure 16:
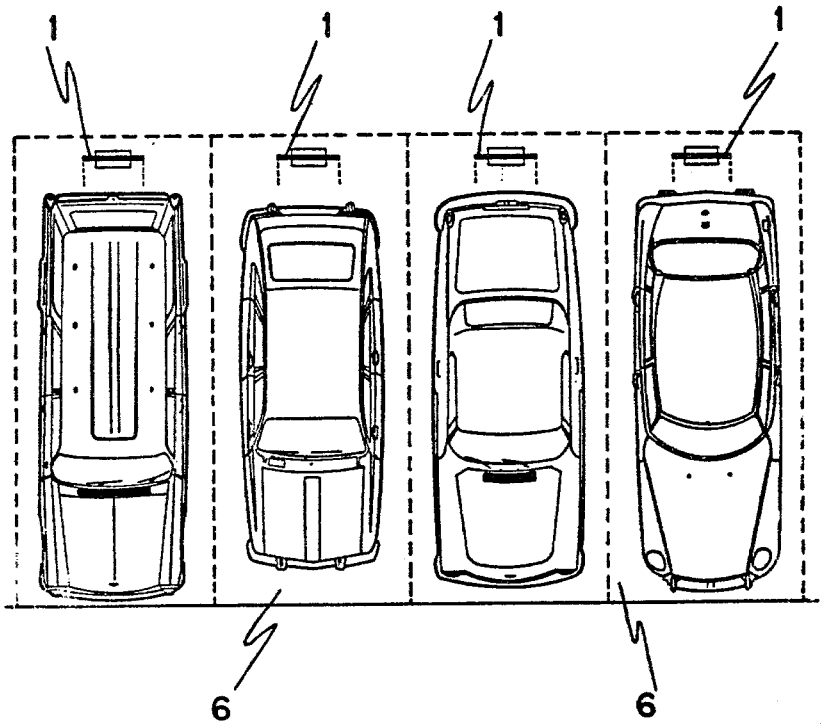

Finally, FIG. 16 illustrates, schematically, a series of individual parking areas arranged correlatively, in each one of which and at the entrance thereof, a device made according to the invention is fixed.

The discontinuous line indicates the direction of folding of the protecting barriers, which folding takes place precisely inwards of said parking areas so as to allow vehicles to circulate along the zone adjacent to the parking area.

The mentioned figures illustrate that the device for reserving individual parking areas to which this invention refers, comprises a rod or any other generally U-shaped rigid element 1. The parallel legs 2 of said element are substantially shorter than that of the intermediate or horizontal leg 3.

In the specific case of FIGS. 1, 2, 3, 4 and 5, the intermediate or horizontal leg 3 is inserted loosely in at least two clamps 4 which form 90° turning zones in a single direction for the mentioned rod or U-shaped element 1.

The mentioned clamps 4 form an integral part of a platform or plate 5 through which the assembly is mounted on the flooring at the entrance to the individual parking area 6. For information purposes, it can be stated that the approximate dimension of the platform or plate 5 is of 35×20 cms. The platform or plate 5 has a lug 7 provided with a hole 8, which lug 7 should be inserted in a groove 9 existing in a bracket 10 joined to the intermediate or horizontal leg 3 of the generally U-shaped element 1. This gives rise to a fastening means, for example, a padlock or a lock which fixes the vertical position of the parallel legs 2 of the U or rod 1. This vertical position corresponds, as already mentioned, to the operative position of the device.

Reverting to FIGS. 6 to 13, both inclusive, the platform or plate 5 will be a molded or pressed body which will be fixed at the entrance of the parking area 6 through conventional fastening elements to be arranged in the by-pass holes 11, one of which is placed at the front part of said plate or platform 5 and the others in lugs 12 arranged in opposition.

The plate or platform 5, in this case, has the characteristic that it has a bulge 13 which will determine, at the lower part, a longitudinal canal 14, as a rotating coupling zone for the generally U-shaped rigid element 1 and which, consequently, will be determined by the intermediate leg 3 and the parallel legs 2 identical to each other, the ends of which will, optionally, be closed by corresponding plugs or the like 15.

Figure 9:
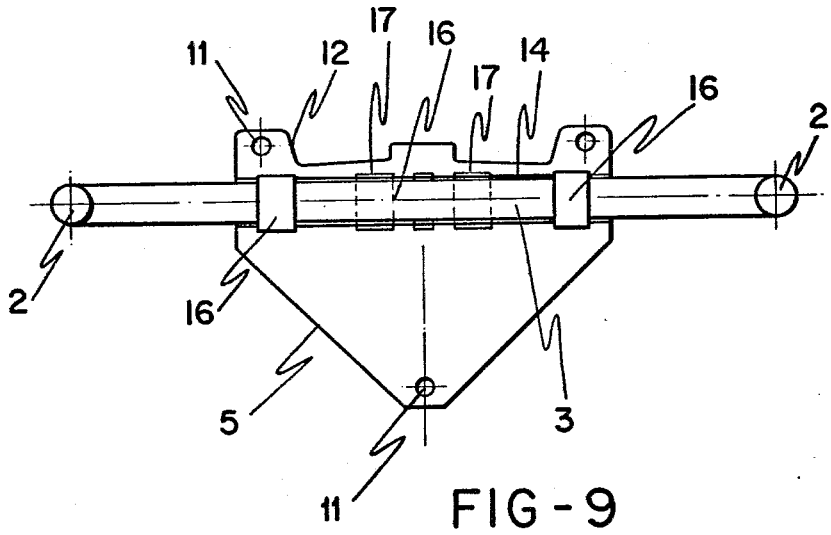

The intermediate leg 3 is perfectly housed in the platform or plate 5 with the help of additional elements 16 which, made of a suitable material, will be arranged in housings 17 as illustrated in FIG. 9. These additional or independent elements 16 will have, at the top, a recess which will coincide with the diameter of the rod, so that they will constitute authentic bearings for the best turn of the rigid element during operation of the device.

In the centre of the intermediate leg 13 of the U-shaped rigid element 1, there is rigidly coupled, for example, by welding, a yoke 18 which projects from the upper part of the platform or plate 5 through a groove 19 made in a bulge or "head" 20 with which said plate or platform 5 is provided for such purpose. The mentioned groove 19, as can be seen in FIG. 10, establishes in the mentioned head 20 two seating faces 21 and 22 which exactly fix the 90° turn for the U-shaped rigid element 1. In the head 20 there is made a transversal recess 23 which facilitates the application of the padlock 24 on the mentioned yoke 18, so that in this postion the parallel legs 2 of the rigid element 1 are perfectly vertical, which implies the operative position of the device, as illustrated in FIG. 13.

If, in the mentioned position of the yoke 18 and due to the presence of the padlock 24, the device is in conditions to prevent a vehicle from entering or leaving the parking area in question, in the opposite position, that is to say, when the yoke 18 faces the seating 22 whereby the U-shaped rigid element 1 will be arranged parallely with respect to the plate 5 (inoperative position of the device as illustrated in FIG. 15), the presence of the padlock in this position prevents the device from being unduly raised since the padlock 24 will butt against the front of the head 20. In this way, the driver of the automobile cannot knock against the device inasmuch as the rigid element had not been unduly raised.

FIG. 16 illustrates the different zones of the individual parking areas 6 protected with the described device in its two preferred embodiments. The discontinuous line indicates the direction of folding of the rigid element to permit the lawful vehicle to enter and leave such parking area freely. The special constitution of the device permits said folding of the rigid element 1 to take place inwards of the mentioned parking areas 6, so that it does not interfere with the presence of the automobile in the interior of said areas, while it also prevents the device from having necessarily to be folded outwards, with the consequent obstacle that this would imply for the vehicles circulating along a zone parallel to said parking areas.

It can be understood from the aforegoing that the device now described functions as an anti-burglary device for vehicles since, once closed, it prevents the vehicle duly occupying the parking area from being withdrawn.

The most important advantages presented by the described device are, in short, the following:

1. It's protections, that is the parallel legs 2 are shorter than the normal height at which the bumpers of the automobiles are situated and can, therefore, not be damaged thereby.

2. It has, as a protection, the mentioned vertical legs 2 of the U-shaped element 1, which vertical legs are spaced from each other and move jointly, forming part of a single support, a support which is represented by the platform 5.

3. They have a width which permit the vehicles to pass over the device when same is in the folded position, and which, in turn, prevents a vehicle from entering between two devices protecting two adjacent parking areas.

4. Due to the special shape of the component parts of said device, any cutting zone, which could damage the wheels of the vehicles when sliding along the folded device, has been eliminated.

The device described in this specification constitutes a mechanical means which definitely overcomes the problems of protecting a parking area, since the robustness, efficiency and simplicity of functioning thereof, prevents any future unlawful driver from using the protected parking area, although the device is folded so that a vehicle can pass, since he will be afraid of being enclosed without the possibility of leaving. This guarantees the rights of the lawful owners of the parking areas, contributing in this way to ordain and regularize the social conduct of the drivers.

The device functions, also, as an anti-burglary device for vehicles, since once closed it prevents the vehicle occupying the parking area from being withdrawn.

We claim:

1. A barrier device for preventing unauthorized use of a parking area and for preventing unauthorized removal of a vehicle lawfully occupying the parking area, said barrier device comprising:

a generally U-shaped rigid barrier element including a horizontal member having extending from opposite ends thereof two parallel leg members;

a flat plate including means for rigidly fixing said plate to a floor adjacent an entrance to a parking area;

said flat plate including bearing means for rotatively supporting said barrier element;

said barrier element being fixed to said flat plate with said horizontal member rotatively supported by said bearing means for rotation in opposite directions about the axis of said horizontal member between an inoperative position, whereat said leg members extend substantially parallel to said flat plate and the floor of the parking space, and an operative position, whereat said leg members extend substantially vertically to said flat plate and the floor of the parking space;

stop means on said barrier element for cooperative abutment with said flat plate for limiting the extent of rotation of said barrier element with respect to said flat plate in at least one of said opposite directions and for thereby defining said operative position;

locking means cooperable with said stop means and with said flat plate for preventing rotation of said barrier element from said operative position to said inoperative position;

said horizontal member having a length sufficient to allow a vehicle to pass over said barrier element when said barrier element is in said inoperative position; and said leg members having a length such that, when said barrier element is in said operative position, the upper ends of said leg members reach a height which is below the level of a bumper of a vehicle but which is sufficient to contact the undercarriage or lower parts of the vehicle, thereby presenting a barrier to the movement of the vehicle into or from the parking area.

2. A device as claimed in claim 1, wherein said stop means comprises a bracket integral with and extending outwardly from said horizontal member at a position such that, upon rotation of said barrier element from said inoperative position, said bracket will abut with said flat plate when said barrier element is in said operative position.

3. A device as claimed in claim 2, further comprising an opening in said bracket, and a lug extending upwardly from said flat plate at a position to extend through said opening when said barrier element is in said operative position, said lug having a hole therein, and wherein said locking means comprises a member insertable into said hole to abut with said bracket.

4. A device as claimed in claim 1, wherein said stop means comprises means for alternate abutment with first and second separate stop surfaces of said flat plate for limiting the extent of rotation of said barrier element with respect to said flat plate in both said opposiet directions and for thereby defining both said operative position and said inoperative position, and wherein said locking means comprises means for preventing rotation of said barrier element when said barrier element is in both said operative position and said inoperative position.

5. A device as claimed in claim 4, wherein said flat plate has an integral raised portion having extending therethrough an elongated channel, said horizontal member extending through said channel, said raised portion having extending therethrough a radially and circumferentially extending groove, said groove having circumferentially spaced opposite end surfaces which comprise said first and second separate stop surfaces, and said stop means comprises a yoke integral with and extending outwardly from said horizontal member and through said groove at a position such that said yoke will abut said first stop surface when said barrier element is in said inoperative position and such that said yoke will abut said second stop surface when said barrier element is in said operative position.

6. A device as claimed in claim 5, wherein said first and second stop surfaces are circumferentially spaced by approximately 90°.

7. A device as claimed in claim 5, wherein said yoke has a hole therethrough, the radial depth of said groove adjacent said first and second stop surfaces is such that said hole in said yoke is exterior of said raised portion, the radial depth of said groove intermediate said first and second stop surfaces is such that said hole in said yoke is within said groove, and wherein said locking means comprises a member insertable into said hole to abut with exterior surfaces of said raised portion.

8. A device as claimed in claim 5, wherein said bearing means comprises bearing members inserted into said channel, said bearing members having upper convex surfaces complementary to the contour of said horizontal member.

* * * * *